United States Patent [19]

Painter et al.

[11] 4,321,721

[45] Mar. 30, 1982

[54] MANUFACTURE OF FOOTWEAR

[75] Inventors: Donald S. Painter, Comberton; Christopher Graeme-Barber, Great Shelford, both of England

[73] Assignee: K. Shoemakers Limited, Kendal, England

[21] Appl. No.: 127,141

[22] Filed: Mar. 4, 1980

[30] Foreign Application Priority Data

Mar. 9, 1979 [GB] United Kingdom ..... 08329/79
Jul. 20, 1979 [GB] United Kingdom ..... 25365/79

[51] Int. Cl.[3] ..... A43D 9/00; A43B 13/42

[52] U.S. Cl. ..... 12/146 C; 36/68; 12/1 W

[58] Field of Search ..... 12/1 W, 1 A, 1 R, 53.1, 12/61 A, 146 C; 36/68, 69

[56] References Cited

U.S. PATENT DOCUMENTS 2,487,421 11/1949 Calder ..... 12/146 C
3,399,413 9/1968 Berkson ..... 12/146 C

*Primary Examiner*—Patrick D. Lawson
*Attorney, Agent, or Firm*—Fleit & Jacobson

[57] ABSTRACT

A method of manufacturing a shoe comprises the step of dry or moist heat setting a lasted shoe upper, with or without a protective coating as necessary, by total or partial immersion in a bath of heated liquid or fluidized solid material. The lasted shoe upper may contain a stiffener element and particularly a heel stiffener made of fibre reinforced thermoplastic or thermosetting polymeric material which becomes cured by the heat treatment.

15 Claims, 1 Drawing Figure

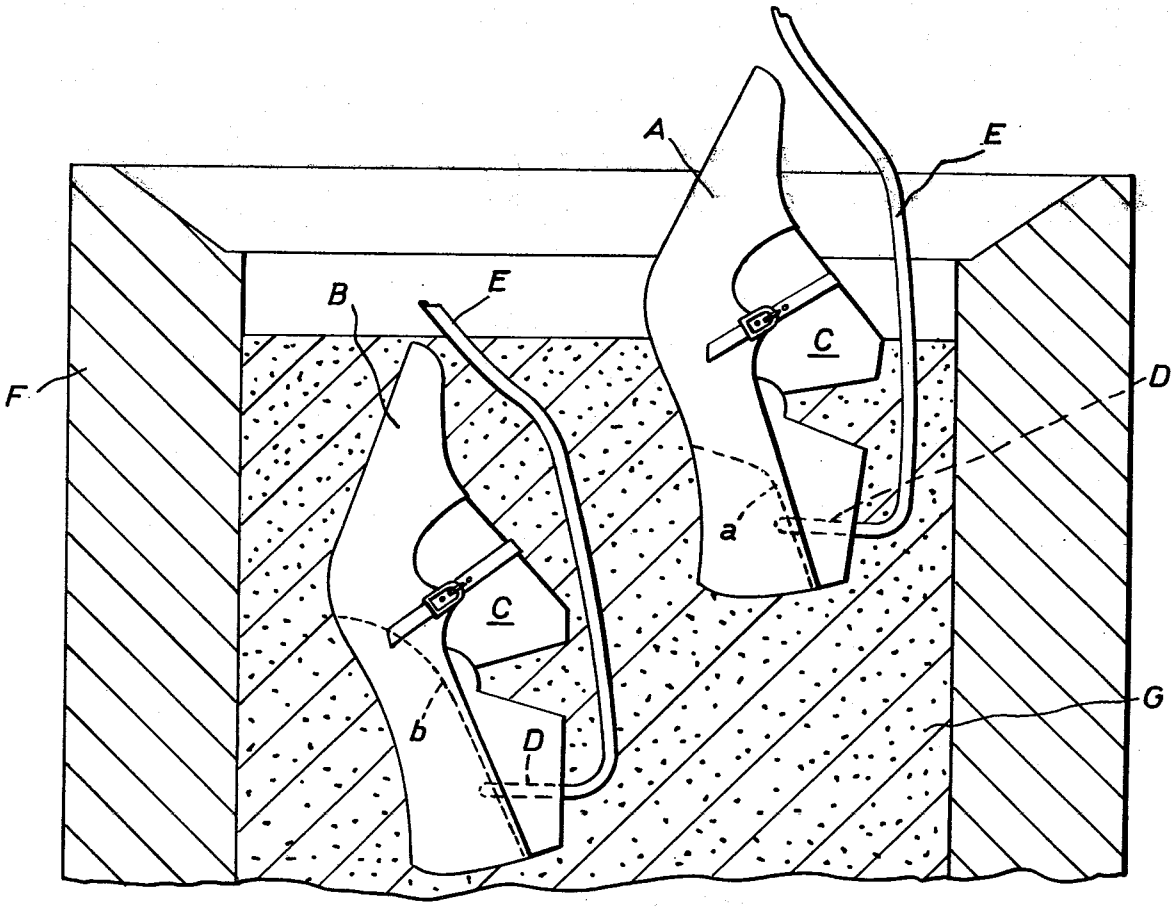
D
G
E
C
a
A
E
C
D
b
B
F

MANUFACTURE OF FOOTWEAR

BACKGROUND OF THE INVENTION

1. Field of the Invention

This invention relates to improvements in the manufacture of footwear and has been devised with the main object of producing a shoe with an upper having an improved shape-retaining performance by means of an improved and novel mode of heat setting the lasted shoe.

2. Description of the Prior Art

This improved and novel heat setting mode has been devised as a result of a consideration of the performance in use of the heel region of a conventional shoe upper. In particular it is well known that the heel region of a shoe upper has to change shape to allow the foot to enter. This can result in distortion of the heel region, and distortion can also happen if the wearer's foot is significantly broader or of different shape than the last on which the shoe was made. It is desirable both for comfort and for appearance that the heel part of the shoe upper should return to its original shape and should resist this distortion to some degree. For this purpose it is the practice to heat set the shoe upper and to insert stiffeners in the heel and other parts of the shoe upper.

Stiffeners may take various forms and be made of various materials as summarized in the four following paragraphs.

1. Thermoplastic Flat Stiffeners are widely used. The stiffener is inserted between the lining and outside in the upper assembly in a flat form and it then has to be heated before lasting and set after lasting. There are disadvantages due to having to apply heat before lasting, in the stiffener yielding and distorting in wear because it is insufficiently strong, and in the difficulty of getting the stiffener to conform tightly to the last shape.

2. Premoulded Fibre/Leather Board Stiffeners.

These may have a thermally activated adhesive coating applied and may contain a small amount of Thermoplastic material. This stiffener is stronger but it is difficult to get the exact mould shape for each size and fitting of last, and it is difficult to insert it into the upper assembly and carry out the lasting operations in such a way that the shoe is correctly lasted. It is expensive if good quality leather board is used, and it is ineffective if cheaper board mixes are used. Also its thickness makes the seat of the shoe bulky in appearance.

3. Solvent Activated Flat Stiffeners are frequently used. These produce a very strong final stiffening shape, but they are very difficult to use in the lasting process as the solvent tends to strike through and damage the upper leather. It is also difficult to get this stiffener to correspond precisely to the last shape.

4. Plastic Moulded Stiffeners. This gives a very strong permanent shape to the shoe, and it may be so strong that it is uncomfortable to some wearers whose feet do not correspond with the last shape. The main disadvantages are that it is not easy to bond this stiffener to the upper or to the insole, and it is very expensive to provide metal moulds for the number of different shapes required.

Apart from the foregoing it is found that whilst conventional heat setting relaxes the strains in a lasted upper it also softens a thermoplastic stiffener. If too much tension has been applied in lasting and if the stiffener softens before the strains are relaxed distortion will take place. In conventional heat setting there is the danger that the upper (particularly the top line) may come away from the last contour.

SUMMARY OF THE INVENTION

In accordance with the present invention in its widest aspect a method of manufacturing a shoe comprises the step of dry or moist heat-setting a lasted shoe upper, with or without a protective covering as necessary by total or partial immersion in a bath of heated liquid or fluidised solid material.

It is a characteristic feature of such a method that it results in a uniform pressure being applied to the upper to prevent departure of the upper from the last contour.

Preferably there is inserted in the shoe upper prior to lasting a flat stiffening element made of fibre reinforced thermoplastic or thermosetting material which becomes moulded to the shape of the last and cured by the heat treatment. Various material may be used for the stiffener, as hereinafter detailed but a composite of polyester resin or epoxide resin with glass fibre has been found to be extremely effective.

Use of a stiffener made of such materials facilitates lasting operations because it is flat. Its use further provides benefits to the wearer of the shoe in that it is a strong and durable stiffener, and its edges can be caused to flow into the line of the shoe so that the shoe is comfortable. Moreover the shape of the shoe with a stiffener of this kind can be made to correspond very precisely to the shape of the last so that there is precision and uniformity in production.

Also some of the difficulties in making a shoe associated with long stiffeners are greatly eased whilst the shoe in its final form can be made to look more handsome and less bulky than when a pre-moulded stiffener is used.

The invention also consists in a method of manufacturing a shoe which comprises the steps of cutting a stiffening element of fibre reinforced thermoplastic or thermo-setting polymeric material to shape in a flat form, inserting the stiffener between the lining of the shoe and the outside, making the stiffener malleable if necessary by applying a small amount of heat thereto, lasting the shoe, and then heat setting the stiffener by immersing at least that part of the shoe which embodies the stiffener with or without a protective covering as necessary, in a bath of liquid or fluidised solid material whereby heat transfer takes place uniformly across the shoe surface and sets the stiffener over its whole area to the shape of the last. Preferably fluidisation is caused by passing dry or humidified hot air through the solid material particles in the bath. Alternatively fluidisation may be caused by passing dry or humidified cold air through heated solid material particles in the bath. A sheet of polymeric material or other material such as metal foil may be applied to the shoe, or the shoe is enclosed in a bag of such a material before immersion in the liquid or fluidised material to protect the surface of the upper, this protective material being finally removed. The polymeric material could alternatively be applied by shrink wrapping. Alternatively the upper could be protectively coated with polymeric or other suitable material applied by spraying, dipping or brushing.

Prior to total or partial immersion in the liquid or fluidised solid material a lasted upper may either (1) be substantially dry; (2) contain residual moisture from a moulding operation at lasting; or (3) contain moisture which has been specially introduced.

Preferably the fluidising material in the bath is fine sand, aluminium oxide particles or glass ballotini with or without a lower layer of material such as for instance zirconium oxide which does not fluidise but acts as an air diffuser. A suitable temperature/treatment time could be 120° C./15 minutes.

As an alternative to fluidised solid material, a liquid such as oil, water or salt water which may give rates of heat transfer typically at or above a rate of 75 Btu/hr/ft$^2$/per °F. may be used.

The flat preimpregnated material does not have to be of uniform substance: usually it will be desirable to make it in two or three different layers so that there is more stiffening in those parts where it is multi-layered.

Further developments which are envisaged may reduce the time the shoes have to be immersed, provide for their automatic release, and ensure that only certain parts of the lasted shoe are immersed.

The second main advantage of the present invention is that more effective heat setting can be achieved. An improvement of 20–30% measured as a proportion of last shape which is no longer lost after removal of the upper from the last is attainable.

Also an improved top line clip, that is to say an upper with an improved ankle region grip for the wearer can be achieved.

It is a further advantage of the method, when using a bath with fluidised material, that by the combination of pressure across the surface of the upper, and heat, the appearance of the shoe can be improved by a kind of polishing action.

It is to be understood that the invention is also applicable to the incorporation of stiffening parts other than heel stiffeners. Thus a similar type of material may be used as a toe reinforcement and heatset by the same method.

Further, the insole can be made partly of this heat setting preimpregnated material and caused to conform to the shape of the last bottom by use of the fluidised bath after it has been roughly attached. The advantages of this are in the precision of insole moulding, in the characteristics of the insole itself in providing a very hard backpart and in some cases in allowing shoes to be made without the steel shank which would otherwise have been necessary to support the backpart.

This same heat settable material may also be used for reinforcing other parts of the upper where a degree of stiffness is required conforming to the shape of the last.

BRIEF DESCRIPTION OF THE DRAWING

A typical and preferred mode of procedure in accordance with the present invention is hereinafter described by reference to the accompanying drawing which illustrates the mode of treatment of a shoe in a fluidising bath.

DESCRIPTION OF THE PREFERRED EMBODIMENTS

Before describing the method provided by the present invention, the material forming the stiffening element will be described.

The material which is used for the stiffener is a sheet of satin woven glass fabric which is impregnated with unsaturated polyester resin and partially cured to render its surface substantially tack free. This material has the following specification:

Resin: Isophthalic polyester with benzoyl peroxide initiator Resin content of pre-impregnated sheet 32±2% by weight

Fabric Construction

Weave: 8 shaft satin
Weight: Nominal 435 gsm (±10%)
Threads per dm
  Warp: 193
  Weft: 118
Yarn count:
  Warp: EC68
  Weft: EC934
Thickness: 0.41 mm nominal
Tensile strength:
  Warp 530 Kgf/5 cm
  Weft 63 Kgf/5 Cm This material is anisotropic with a strength ratio of about 5:1 and is made up into two or more layers.

The material is supplied in flat sheet form and may be cut to shape by conventional means such as steel strip knives, roller knives or even scissors. The flat flexible cut forms are incorporated into the heel section of the shoe upper either during normal closing room operations or they may be slipped into the heel pocket on the shoe building track. In either case the stiffener is not finally shaped at this stage and has no shape memory; consequently it is impossible to encounter problems arising from misaligned pre-shaped stiffeners which can cause faulty top lines after lasting.

After lasting operations have been completed, the lasted shoe is treated in a fluidising bath. The one FIGURE shows two fully lasted shoe uppers A, B, respectively with a short stiffener a and an extended stiffener b on lasts C. The back part of each last has a thimble D which accommodates the end of a cranked support rod E by which the lasted upper is caused to be partially or totally immersed in a fluidising bath F containing a bed G of fine sand or aluminium oxide.

If desired, colouring material may be added to the fluidising material to enhance the appearance of the upper.

The shoes while wholly or partly immersed in the fluidised bed will normally be enveloped in protective bags (not shown) made of a polyester or other suitable material. Alternatively a cover could be vacuum formed onto each shoe and subsequently removed.

Air is fed into the bath to cause fluidising of the bed at a temperature of 120° C. the shoes remaining in the bath for about 15 minutes, a period which is sufficient to heat set the stiffeners and the uppers.

By the type of glass fabric, the type of resin, and the shape, size and number of layers of material used for the stiffener, it is possible to produce shoes which have the following advantages over those made with preshaped stiffeners:

(i) improved appearance after lasting, due to the total compliance of the stiffener to the last;

(ii) a reduced substance in the heel due to the high strength of the stiffener compared with leatherboard stiffeners; and (iii) improved shape retention during wear, due to the greater spring back of the stiffener which does not creep under conditions of high humidity and maintained stress.

Alternatively to the materials particularly described above, stiffeners can be manufactured from a wide range of reinforcing materials including woven and non-woven glass and textile fibres, and using polyester, epoxy, phenolic, melamine and other resins.

Although reference in the foregoing description has been made to the treatment of shoes it is to be understood that the invention in its widest aspect is applicable to other articles of outer footwear with uppers which need to be heat set or to incorporate a heel or other stiffening element in order to maintain their shape. In the appended claims "shoe" connotes any such article of outer footwear.

We claim:

1. A method of manufacturing a shoe which comprises the steps of cutting a stiffening element of fibre reinforced thermoplastic or thermo-setting plastics material to shape a stiffener in a flat form, inserting the stiffener between the lining of the shoe and the shoe upper, making the stiffener malleable, if necessary, by applying a small amount of heat, lasting the shoe upper, and then heat setting the shoe upper and the stiffener by immersing at least that part of the shoe which embodies the stiffener in a bath of fluidised solid material whereby heat transfer takes place uniformly across the shoe surface and forms or cures the stiffener over its whole area to the shape of the last.

2. A method in accordance with claim 1, further comprising applying a protective covering to the shoe upper prior to immersing the shoe in the bath, the protective covering being a liquid which is applied to the upper by dipping, brushing or spraying before entry of the shoe in the bath and being removed after exit from the bath.

3. A method of manufacturing a shoe which comprises:

at least partially immersing a lasted shoe upper with a protective covering in a bath of fluidised solid material; and heating the bath to thereby dry heat set the lasted shoe upper.

4. A method in accordance with claim 3, further comprising inserting in the shoe upper prior to lasting a stiffening element made of fibre reinforced thermoplastic or thermosetting plastics material which becomes cured by the heat treatment.

5. A method in accordance with claim 3, wherein the protective covering is sheet material which surrounds the upper whilst the shoe is in the bath.

6. A method in accordance with claim 7 wherein the sheet material is shrink-wrapped around the shoe.

7. A method in accordance with claim 3, further comprising inserting in the shoe upper prior to lasting a stiffening element made of fibre reinforced thermoplastic or thermosetting plastics material which becomes formed by the heat treatment.

8. A method in accordance with claim 4, or claim 1, wherein the stiffening element comprises at least one layer of a glass fibre reinforced polyester or epoxide resin.

9. A method in accordance with claim 4 or 3, wherein the protective covering is a liquid which is applied to the upper by dipping, brushing or spraying before entry of the shoe in the bath and is removed after exit from the bath.

10. A method in accordance with claim 4, 1, or 3, wherein the fluidising bath contains fine sand, aluminum oxide or glass ballotini and a lower layer of a non-fluidising air diffusing material such as zirconium oxide.

11. A method as set forth in claim 4, 1, or 5, wherein the stiffening element is made in two or more layers.

12. A method as set forth in claim 4 or 1, wherein the stiffening element is a heel stiffener.

13. A method as set forth in claim 4, 1, or 5, wherein the stiffening element forms part of the shoe insole or some other part of the shoe upper excluding the heel.

14. A method in accordance with claim 4, 1 or 5, wherein the stiffening element is a sheet of satin woven glass fabric which is impregnated with unsaturated polyester or epoxide resin.

15. A shoe stiffening element for use in the method in accordance with claim 4, 1 or 5, and which comprises at least one uncured layer cut from a sheet of glass reinforced unsaturated polyester or epoxide resin.

* * * * *